US006001780A

United States Patent [19]

Ho et al.

[11] Patent Number: 6,001,780

[45] Date of Patent: Dec. 14, 1999

[54] ASHLESS LUBRICATING OIL FORMULATION FOR NATURAL GAS ENGINES

[75] Inventors: Andrew W. Ho, Pinole; Mark R. Logan, San Ramon; Laura J. Whaley, Vallejo, all of Calif.

[73] Assignee: Chevron Chemical Company LLC, San Francisco, Calif.

[21] Appl. No.: 09/107,703

[22] Filed: Jun. 30, 1998

[51] Int. Cl.[6] ..... C10M 141/12; C10M 157/10

[52] U.S. Cl. ..... 508/192; 508/287; 508/293

[58] Field of Search ..... 508/192

[56] References Cited

U.S. PATENT DOCUMENTS

| | | | |
|---|---|---|---|
| 3,219,666 | 11/1965 | Norman et al. | 508/287 |
| 3,254,025 | 5/1966 | LeSuer | 508/192 |
| 3,287,271 | 11/1966 | Stuart et al. | 252/49.9 |
| 4,147,640 | 4/1979 | Jayne et al. | 252/45 |
| 4,330,420 | 5/1982 | White et al. | 252/32.7 |
| 4,639,324 | 1/1987 | Lam | 252/48.6 |
| 5,110,488 | 5/1992 | Tipton et al. | 508/192 |
| 5,320,765 | 6/1994 | Fetterman, Jr. et al. | 252/32.7 |
| 5,330,667 | 7/1994 | Tiffany, III et al. | 508/192 |
| 5,716,912 | 2/1998 | Harrison et al. | 508/192 |

*Primary Examiner*—Ellen M. McAvoy
*Attorney, Agent, or Firm*—S.G. K. Lee; E. A. Schaal

[57] ABSTRACT

The present invention provides an ashless lubricating oil composition that improves the corrosion properties in natural gas engines. The ashless lubricating oil composition comprises:

a) a major amount of base oil of lubricating viscosity;

b) from about 1 to 6 wt % of an untreated polyalkylene or polyalkenyl succinimide dispersant; and c) from about 1 to 6 wt % of a borated polyalkylene or polyalkenyl succinimide dispersant.

11 Claims, No Drawings

ASHLESS LUBRICATING OIL FORMULATION FOR NATURAL GAS ENGINES

The present invention relates to an ashless lubricating oil composition. More particularly, the present invention relates to an ashless lubricating oil composition comprising an untreated and a borated polyalkylene or polyalkenyl succinimide dispersant. In a further aspect, this invention relates to a method of preparing this composition and its use in natural gas engine oils. The composition of this invention provides improved corrosion protection in natural gas engines.

BACKGROUND OF THE INVENTION

One of the causes of wear in an internal combustion engine is corrosion of the metal surfaces of the engine, particularly lead and copper metal surfaces caused by the action of various corrosion-promoting compounds which accumulate in the crankcase of the engine. The corrosion-promoting compounds present in the crankcase are principally weak organic acids which may result from nitration and oxidation of the lubricating oil due to contamination by blow-by gases and exposure of the lubricant to high temperatures in the piston and ring zones. Regardless of the source of the corrosion-promoting compounds, it is important to protect the engine from the deleterious action of such compounds and thereby reduce engine wear. For the purpose of preventing corrosivity by these compounds on the various engine parts, it is necessary to incorporate dispersants, detergents, and corrosion inhibitors in the lubricating oil composition, to limit the formation of corrosion products and protecting metal surfaces.

Historically, crankcase oils usually contain ash from detergents, anti-wear products with metals, e.g., Zn, Ca, and the like. Although these metal-containing organic compounds have corrosion inhibition activity as well as detergency, they form undesirable ash deposits in the engine. Ash deposits can lower engine performance by fouling spark plugs, contributing to combustion chamber deposits that cause preignition, or facilitating carbon deposits in two-cycle engine ports and thus are undesirable in many applications. However, it is quite challenging to control corrosion without metal-containing additives like detergents and anti-wear agents. Ashless lubricants would have the advantage of reducing combustion chamber deposits. For example, U.S. Pat. No. 5,320,765, issued on Jun. 14, 1994 to Fetterman, Jr. et al., disclose marked reductions in diesel engine carbon deposits with lubricating oil compositions containing a high molecular weight ashless dispersant, oil soluble antioxidants, and oil soluble dihydrocarbyl dithiophosphate.

Currently, ashless products are created with metal pacifiers such as terephthalic acid (TPA) to protect the metal surface. However, as highly effective as TPA is in corrosion inhibition, it is very oil insoluble and may contribute to deposits in the engine at low engine temperatures. Thus, it would be desirable to attain the corrosion inhibition performance comparable to TPA but devoid of the insoluble deposit problem associated with TPA.

It is also desirable to minimize the amount of phosphorus in lubricants. Although phosphorus does not contribute to ash, it can lead to poisoning of catalysts in pollution control devices such as emission catalysts or traps when amounts of phosphorus make their way into the exhaust system. Exemplary of references directed to the reduction in phosphorus-containing lubricant additives are U.S. Pat. Nos. 4,147,640, 4,330,420, and 4,639,324.

Combined dispersant-corrosion inhibitors are known in the art. For instance, U.S. Pat. No. 3,287,271, issued Nov. 22, 1966 to Stuart, discloses a novel composition which provides both corrosion inhibition and detergency by combining a polyamine with a high molecular weight succinic anhydride and then contacting the resulting product with a dicarboxylic acid, having the carboxyl groups separated by at least three annular carbon atoms.

U.S. patent application Ser. No. 09/015,801, filed Jan. 29, 1998, discloses a lubricating oil composition for internal combustion engines giving improved soot dispersancy. That lubricating oil composition has a mixture of borated and carbonated polyalkylene succinimides derived from different molecular weight polyalkylenes. The molecular weight of the polyalkylenes from which the carbonated polyalkylene succinimide is derived is at least 300 greater than the molecular weight of the polyalkylenes from which the borated polyalkylene succinimide is derived. The lubricating oil compositions of the examples contained in this application included significant portions of metal detergents and zinc dithiophosphates creating high ash content and high phosphorus content formulation.

SUMMARY OF THE INVENTION

Pursuant to this invention, an ashless lubricating oil composition suitable for natural gas engines, which provides adequate corrosion inhibition yet contains little or no metal-containing additives, is provided. This invention is obtained by including a borated succinimide dispersant in the formulation. As demonstrated by the CRC L-38 test, which is an industry standard test for corrosiveness, the inclusion of a borated succinimide dispersant in an ashless formulation provides for surprising improved corrosion performance. The ashless lubricating oil composition of the present invention also has a low phosphorus, low ash content. Moreover, the insoluble deposit problem associated with TPA can also be avoided.

The present invention provides an ashless lubricating oil composition comprising:

a) a major amount of base oil of lubricating viscosity;

b) from about 1 to 6 wt % of a untreated polyalkylene or polyalkenyl succinimide dispersant; and c) from about 1 to 6 wt % of a borated polyalkylene or polyalkenyl succinimide dispersant.

The untreated and borated polyalkylene or polyalkenyl succinimide dispersants are independently derived from a hydrocarbyl group having an average molecular weight of about 600 to 3,000; more preferably from about 950 to 2,500; most preferably about 1,300. Preferably, the polyalkylene or polyalkenyl group is a hydrocarbyl group derived from polypropylene, polybutene, or polyalphaolefin oligomers of 1-octene or 1-decene. Most preferably, the polyalkylene or polyalkenyl group is a hydrocarbyl group derived from polyisobutene. Still more preferably, the polyisobutene contains at least about 20 wt % of a methylvinylidene isomer.

The untreated polyalkylene or polyalkenyl succinimide dispersant can be prepared by reacting under reactive conditions, a mixture of a polybutene succinic acid derivative, an unsaturated acidic reagent copolymer of an unsaturated acidic reagent and an olefin, and a polyamine. Likewise, the borated polyalkylene or polyalkenyl succinimide dispersant can be similarly prepared followed by further treatment with a boron compound.

The present invention further provides a method of producing the ashless lubricating oil composition by blending a mixture of a major amount of a base oil of lubricating viscosity and an effective amount of an untreated and borated polyalkylene or polyalkenyl succinimide dispersant of the present invention.

Among other factors, the present invention is based on the surprising discovery that the corrosion properties in a natural gas engine can be improved by adding an effective amount of a lubricating oil composition of the present invention. More particularly, the present invention relates to an ashless lubricating oil composition comprising an untreated and a borated polyalkylene or polyalkenyl succinimide dispersant. Formulations containing the untreated succinimide dispersant without the borated succinimide dispersant failed to demonstrate any improvement in corrosion performance. Using the borated succinimide exclusively would require too high a concentration of borated material which would exceed the ash limitation considered to be ashless. It is important that the ash content remain below 0.10 wt % for the purpose of this invention.

DETAILED DESCRIPTION OF THE INVENTION

As mentioned above, the present invention provides an ashless lubricating oil composition that improves the corrosion properties in natural gas engines. Prior to discussing the present invention in further detail, the following terms will be defined.

Definitions

As used herein the following terms have the following meanings unless expressly stated to the contrary.

The term "ash" refers to a metal-containing compound wherein the metal can be zinc, sodium, potassium, magnesium, calcium, lithium, barium, and the like, as measured by ASTM D874.

The term "ashless" refers to less than 0.10 wt % ash content in the lubricating oil composition.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups are generally free of aliphatic unsaturation, i.e., olefinic or acetylenic unsaturation, but may contain minor amounts of heteroatoms, such as oxygen or nitrogen, or halogens, such as chlorine.

The term "succinimide" is understood in the art to include many of the amide, imide, etc. species which are also formed by the reaction of a succinic anhydride with an amine and is so used herein. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are hereby incorporated by reference.

The term "untreated" refers to a polyalkylene or alkenyl succinimide which has not been further treated with a cyclic carbonate or linear mono- or poly-carbonate or boron oxide, boron halide, boric acid, and esters of boric acid, under reactive conditions.

The term "base oil of lubricating viscosity" generally refers to an oil having a viscosity of 3–20 cSt at 100° C. in the case of lubricating oil compositions and may be a single oil or a blend of oils.

SUCCINIMIDE DISPERSANT

The present invention relates to an ashless lubricating oil composition involving a combination of untreated and borated succinimide dispersants.

Untreated Succinimide Dispersant

Preferably, the lubricating oil composition of the present invention comprises from about 1 to 6 wt % of a untreated polyalkylene or polyalkenyl succinimide dispersant.

The polyalkylene or polyalkenyl succinimide dispersants used in the lubricating oil composition of the present invention can be prepared by conventional processes. In brief, the untreated, borated succinimide dispersant is preferably prepared by reacting under reactive conditions a mixture of a polybutene succinic acid derivative, an unsaturated acidic reagent copolymer of an unsaturated acidic reagent and an olefin, and a polyamine, such as disclosed in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

More than one untreated polyalkylene or polyalkenyl succinimide dispersant may be present in the lubricating oil composition. Additionally, the lubricating oil composition may also contain a non-borated polyalkylene or polyalkenyl succinimide dispersant that has been post-treated with ethylene carbonate. However, as exemplified in the example below, the addition of a non-borated polyalkylene or polyalkenyl succinimide dispersant that has been post-treated with ethylene carbonate does not necessarily improve the overall wear performance of the lubricating oil formulation.

Borated Succinimide Dispersant

Preferably, the lubricating oil composition of the present invention comprises from about 1 to 6 wt % of a borated polyalkylene or polyalkenyl succinimide dispersant.

The borated succinimide dispersant is preferably prepared by reacting under reactive conditions a mixture of a polybutene succinic acid derivative, an unsaturated acidic reagent copolymer of an unsaturated acidic reagent and an olefin, and a polyamine, such as taught in U.S. Pat. No. 5,716,912, to prepare the succinimide, followed by treatment with a boron compound selected from the group consisting of boron oxide, boron halide, boric acid, and esters of boric acid, under reactive conditions. Similarly by following the similar procedure, the untreated succinimide described above can be borated. The borated succinimide dispersant is from about 1 to 6 wt % of the lubricating oil composition.

The advantages of the borated polyalkylene or polyalkenyl succinimide dispersant are TBN contribution and prevention of corrosion. Without the borated succinimide dispersant in the low ash lubricating formulation, as shown in the comparatives examples described below, bearing weight loss increased significantly, an indication that increased wear occurred. Hence, it is the addition of the borated succinimide dispersant to the untreated succinimide that provides the unexpected anti-wear performance.

The present lubricating oil composition can be prepared by physically mixing the untreated polyalkylene or polyalkenyl succinimide dispersant and the borated polyalkylene or polyalkenyl succinimide dispersant. The polyalkylene or polyalkenyl succinimide composition might have a slightly different composition than the initial mixture, because the components may interact either with each other or other additives to form different compounds or complexes.

BASE OIL OF LUBRICATING VISCOSITY

The base oil of lubricating viscosity used in such compositions may be mineral oils or synthetic oils of viscosity suitable for use in the crankcase of an internal combustion engine. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having desired viscosity. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

OTHER ADDITIVE COMPONENTS

The following additive components are examples of some of the components that can be favorably employed in the present invention. These examples of additives are provided to illustrate the present invention, but they are not intended to limit it:

1. Metal Detergents

Sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

2. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-I-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal dithiocarbamate (e.g., zinc dithiocarbamate), and methylenebis (dibutyldithiocarbamate). The anti-oxidant is generally incorporated into an engine oil in an amount of about 0 to 10 wt %, preferably 0.05 to 3.0 wt %, per total amount of the engine oil.

3. Anti-Wear Agents

As their name implies, these agents reduce wear of moving metallic parts. Examples of such agents include, but are not limited to, phosphates, phosphites, carbamates, esters, sulfur containing compounds, and molybdenum complexes.

4. Rust Inhibitors (Anti-Rust Agents)

a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.

b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

5. Demulsifiers

Addition product of alkylphenol and ethylene oxide, polyoxyethylene alkyl ether, and polyoxyethylene sorbitan ester.

6. Extreme Pressure Agents (EP Agents)

Zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate.

7. Friction Modifiers

Fatty alcohol, fatty acid, amine, borated ester, and other esters.

8. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

9. Viscosity Index Improvers

Polymethacrylate type polymers, ethylene-propylene copolymers, styrene-isoprene copolymers, hydrated styrene-isoprene copolymers, polyisobutylene, and dispersant type viscosity index improvers.

10. Pour Point Depressants

Polymethyl methacrylate.

11. Foam Inhibitors

Alkyl methacrylate polymers and dimethyl silicone polymers.

LUBRICATING OIL COMPOSITION

The lubricating oil composition of the present invention is useful for imparting improved corrosion properties to natural gas engines. The lubricating oil composition comprises a major part of base oil of lubricating viscosity and an effective amount of the untreated and borated polyalkylene or polyalkenyl succinimide dispersants. The ash content of the lubricating oil composition of the present invention is less than about 0.10 wt %.

In one embodiment, the lubricating oil composition contains:

a) a major amount of base oil of lubricating viscosity;

b) from about 1 to 6 wt % of an untreated polyalkylene or polyalkenyl succinimide dispersant; and c) from about 1 to 6 wt % of a borated polyalkylene or polyalkenyl succinimide dispersant.

In a further embodiment, a lubricating oil composition is produced by blending a mixture of the above components. The lubricating oil composition produced by that method might have a slightly different composition than the initial mixture, because the components may interact.

The components can be blended in any order and can be blended as combinations of components. For example, the untreated polyalkylene or polyalkenyl succinimide dispersant can be blended with the other components before, during, and/or after the boron-treated polyalkylene or polyalkenyl succinimide dispersant, are blended together.

EXAMPLES

The following examples are presented to illustrate specific embodiments of the present invention and synthetic preparations thereof; and therefore these examples should not be interpreted as limitations upon the scope of this invention.

Example 1

Untreated and Borated Succinimide Formulation

The first formulation consists of:

a) 2.5 wt % of an untreated succinimide dispersant derived from 1,300 molecular weight polybutene formed by reacting a polybutene-substituted succinic acid with a heavy polyamine, b) 2.0 wt % of a borated succinimide dispersant derived from 1,300 molecular weight polybutene formed by reacting a polybutene-substituted succinic acid with a heavy polyamine, then post-treating the resulting polybutene succinimide with boric acid, c) 1.0 wt % of an anti-oxidant, d) 0.16 wt % of an anti-wear inhibitor, e) 0.003 wt % of a foam inhibitor, and blended with a base oil of lubricating viscosity. Ash content was 0.05 wt %.

Example 2

Untreated and Borated Succinimide Formulation

The second formulation consists of:

a) 2.5 wt % of an untreated succinimide dispersant derived from 1,300 molecular weight polybutene formed by reacting a polybutene-substituted succinic acid with a heavy polyamine, b) 2.0 wt % a borated succinimide dispersant derived from 1,300 molecular weight polybutene formed by reacting a polybutene-substituted succinic acid with a heavy polyamine, then post-treating the resulting polybutene succinimide with boric acid, c) 1.5 wt % of an anti-oxidant, d) 0.08 wt % of an anti-wear inhibitor, e) 0.003 wt % of a foam inhibitor, and blended with a base oil of lubricating viscosity. Ash content was 0.02 wt %.

Example 3

Untreated and Borated Succinimide Formulation

Example 3 demonstrates that this invention also works when multiple non-borated succinimides are used. This example illustrates a situation where one untreated succinimide is not post-treated with ethylene carbonated and the other non-borated succinimide is ethylene carbonate post-treated. The third formulation consists of:

a) 2.25 wt % of an untreated succinimide dispersant derived from 1,300 molecular weight polybutene formed by reacting a polybutene-substituted succinic acid with a heavy polyamine, b) 2.25 wt % of a non-borated succinimide dispersant derived from 2,200 molecular weight polybutene formed by reacting a polybutene-substituted succinic acid with a heavy polyamine that is subsequently post-treated with ethylene carbonate, c) 2.0 wt % of a borated succinimide dispersant derived from 1,300 molecular weight polybutene formed by reacting a polybutene-substituted succinic acid with a heavy polyamine, then post-treating the resulting polybutene succinimide with boric acid, d) 2.53 wt % of anti-oxidants, e) 0.02 wt % of an anti-wear inhibitor, f) 0.10 wt % of a detergent, and blended with a base oil of lubricating viscosity. Ash content was 0.04 wt %.

Comparative Example A

Untreated Succinimide Formulation

The fourth formulation consists of:

a) 4.5 wt % of an untreated succinimide dispersant derived from 1,300 molecular weight polybutene formed by reacting a polybutene-substituted succinic acid with a heavy polyamine, b) 1.0 wt % of an anti-oxidant, c) 0.16 wt % of an anti-wear inhibitor, d) 0.003 wt % of a foam inhibitor, and blended with a base oil of lubricating viscosity. Ash content was 0.01 wt %.

Comparative Example B

Untreated Succinimide Formulation

The fifth formulation consists of:

a) 2.25 wt % of an untreated succinimide dispersant derived from 1,300 molecular weight polybutene formed by reacting a polybutene-substituted succinic acid with a heavy polyamine.

b) 2.25 wt % of a non-borated succinimide dispersant derived from 2,200 molecular weight polybutene formed by reacting a polybutene-substituted succinic acid with a heavy polyamine that is subsequently post-treated with ethylene carbonate.

c) 2.53 wt % of anti-oxidants, d) 0.02 wt % of an anti-wear inhibitor, e) 0.10 wt % of a detergent, and blended with a base oil of lubricating viscosity. Ash content was 0.01 wt %.

Test Results of Examples 1–3 and Comparative Examples A–B

The bearing weight loss of a lubricating oil formulation containing an effective amount of both the untreated and borated polyalkylene or polyalkenyl succinimide dispersants (Example 1 and 2) of the present invention were compared to the bearing weight loss of a lubricating oil formulation having only the untreated polyalkylene or polyalkenyl succinimide (Comparative Example A). Example 3 shows the results of a run for a formulation with a combination of an untreated succinimide and an ethylene carbonated succinimide with a borated succinimide. Comparative Example B shows the results of a formulation of Example 3 without a borated succinimide. The CRC L-38 test is a standard industry test that measures the corrosiveness of oil in terms of bearing weight loss. Bearing weight loss below 40 mg is considered passing. The lower the number the better the result. The results are shown in the table below.

| | EXAMPLES | | | COMPARATIVE EXAMPLES | |
|---|---|---|---|---|---|
| | 1 | 2 | 3 | A | B |
| Untreated Succinimide, wt % | 2.5 | 2.5 | 2.25 | 4.5 | 2.25 |
| Non-Borated, Ethylene Carbonated Post-treated Succinimide, wt % | — | — | 2.25 | — | 2.25 |
| Borated Succinimide, wt % | 2.0 | 2.0 | 2.0 | — | — |
| Anti-oxidants, wt % | 1.0 | 1.5 | 2.53 | 1.0 | 2.53 |
| Anti-wear, wt % | 0.16 | 0.08 | 0.02 | 0.16 | 0.02 |
| Detergent, wt % | — | — | 0.10 | — | 0.10 |
| Foam Inhibitor, wt % | 0.003 | 0.003 | — | 0.003 | — |
| Bearing Weight Loss, mg | 28.2 | 18.4 | 19.9 | 71.1 | 316.6 |
| Results | PASS | PASS | PASS | FAIL | FAIL |

The above results show the surprising benefit of the borated succinimide dispersants in passivating L-38 bearing weight loss demonstrating improved corrosion performance. When the borated succinimide dispersants were not incorporated as shown in the comparative examples, the bearing weight loss increased significantly beyond the passing threshold. Hence, it is the addition of the borated succinimide dispersant to the untreated succinimide that provides the unexpected anti-wear performance.

While the present invention has been described with reference to specific embodiments, this application is intended to cover those various changes and substitutions that may be made by those skilled in the art without departing from the spirit and scope of the appended claims.

What is claimed is:

1. A method for improving corrosion protection of a natural gas engine, said method comprising lubricating said engine with a lubricating oil composition comprising:

a) a major amount of a base oil of lubricating viscosity;

b) from about 1 to 6 wt % of an untreated polyalkylene or polyalkenyl succinimide dispersant; and c) from about 1 to 6 wt % of a borated polyalkylene or polyalkenyl succinimide dispersant, wherein the ash content of said lubricating oil composition is less than about 0.10 wt %.

2. A method according to claim 1, wherein said lubricating oil composition further comprises from about 0.05 to 3.0 wt % of at least one anti-oxidant.

3. A method according to claim 2, wherein said lubricating oil composition further comprises from about 0.01 to 1.0 wt % of at least one anti-wear agent.

4. A method according to claim 1, wherein the polyalkylene or polyalkenyl group of the untreated succinimide dispersant is a hydrocarbyl group having an average molecular weight of about 600 to 3,000, and the polyalkylene or polyalkenyl group of the borated succinimide dispersant is independently a hydrocarbyl group having an average molecular weight of about 600 to 3,000.

5. A method according to claim 4, wherein the polyalkylene or polyalkenyl group of the untreated succinimide dispersant is a hydrocarbyl group having an average molecular weight of about 950 to 2,500, and the polyalkylene or polyalkenyl group of the borated succinimide dispersant is independently a hydrocarbyl group having an average molecular weight of about 950 to 2,500.

6. A method according to claim 5, wherein the polyalkylene or polyalkenyl group of the untreated succinimide dispersant is a hydrocarbyl group having an average molecular weight of about 1,300, and the polyalkylene or polyalkenyl group of the borated succinimide dispersant is independently a hydrocarbyl group having an average molecular weight of about 1,300.

7. A method according to claim 1, wherein the polyalkylene or polyalkenyl group of the untreated succinimide dispersant is a hydrocarbyl group derived from polypropylene, polybutene, or polyalphaolefin oligomers of 1-octene or 1-decene, and the polyalkylene or polyalkenyl group of the borated succinimide dispersant is independently a hydrocarbyl group derived from polypropylene, polybutene, or polyalphaolefin oligomers of 1-octene or 1-decene.

8. A method according to claim 7, wherein said hydrocarbyl group is derived from polyisobutene.

9. A method according to claim 8, wherein the polyisobutene contains at least about 20 wt % of a methylvinylidene isomer.

10. A method according to claim 1, wherein the untreated polyalkylene or polyalkenyl succinimide dispersant is prepared by reacting a mixture under reactive conditions, wherein the mixture comprises:

a) a polybutene succinic acid derivative;

b) an unsaturated acidic reagent copolymer of an unsaturated acidic reagent and an olefin; and c) a polyamine.

11. A method according to claim 1, wherein the borated polyalkylene or polyalkenyl succinimide dispersant is prepared by reacting a mixture under reactive conditions, wherein the mixture comprises:

a) a polybutene succinic acid derivative;

b) an unsaturated acidic reagent copolymer of an unsaturated acidic reagent and an olefin; and c) a polyamine;

d) followed by treatment with a boron compound selected from a group consisting of boron oxide, boron halide, boric acid, and esters of boric acid, under reactive conditions.

* * * * *